US008578919B2

(12) United States Patent
Macy et al.

(10) Patent No.: US 8,578,919 B2
(45) Date of Patent: Nov. 12, 2013

(54) AMMUNITION MAGAZINE HAVING TWO OR MORE SUPPLY PORTS

(75) Inventors: Omar Alonso Macy, San Jose, CA (US); Loc T. Pham, San Jose, CA (US)

(73) Assignee: Real Action Paintball, Inc., San Jose, CA (US)

( * ) Notice: Subject to any disclaimer, the term of this patent is extended or adjusted under 35 U.S.C. 154(b) by 120 days.

(21) Appl. No.: 13/221,055

(22) Filed: Aug. 30, 2011

(65) Prior Publication Data

US 2013/0047481 A1 Feb. 28, 2013

(51) Int. Cl.
*F41A 9/68* (2006.01)

(52) U.S. Cl.
USPC ..... 124/45

(58) Field of Classification Search
USPC ..... 42/50, 49.01, 49.02, 11, 17, 21, 22, 24, 42/29, 33, 35, 37, 39; 89/33.01, 33.1, 89/33.5; 124/45, 51.1, 52
See application file for complete search history.

(56) References Cited

U.S. PATENT DOCUMENTS

| | | | | | |
|---|---|---|---|---|---|
| 2,147,208 | A | * | 2/1939 | Nolan | 42/49.01 |
| 2,289,067 | A | * | 7/1942 | Owsley | 42/50 |
| 2,383,998 | A | * | 9/1945 | Vesely | 42/50 |
| 2,391,756 | A | * | 12/1945 | Vesely | 42/18 |
| 3,191,332 | A | * | 6/1965 | Ardolino | 42/50 |
| 3,196,568 | A | * | 7/1965 | Reed | 42/18 |
| 4,484,403 | A | * | 11/1984 | Schwaller | 42/50 |
| 5,279,059 | A | * | 1/1994 | Howard | 42/90 |
| 2003/0056777 | A1 | * | 3/2003 | Liang | 124/52 |
| 2012/0160225 | A1 | * | 6/2012 | Cho | 124/52 |

* cited by examiner

*Primary Examiner* — Jonathan C. Weber
(74) *Attorney, Agent, or Firm* — James M. Wu; JW Law Group

(57) ABSTRACT

An ammunition magazine includes a first ammunition supply port ("ASP"), a second ASP, a first ammunition compartment, and a second ammunition compartment. The first ASP, in one embodiment, is able to couple to a coupling surface of the magazine and provide ammunition to a gun when the first ASP is connected to an ammunition loading port ("ALP") of the gun. The second ASP is also coupled to the coupling surface of the magazine and provides ammunition to the gun when the second ASP is connected to the ALP of the gun. The first ammunition compartment occupies a first portion of ammunition capacity of the magazine and is able to arrange ammunition in a column formation. The second ammunition compartment occupies a second portion of ammunition capacity of the magazine and is able to arrange ammunition in a column formation.

12 Claims, 10 Drawing Sheets

AMMUNITION MAGAZINE HAVING TWO OR MORE SUPPLY PORTS

FIELD

The present invention relates to projectile propelling systems or apparatus. More specifically, the present invention relates to ammunition magazines for firearms and paintball markers.

BACKGROUND

A conventional projectile propelling system, such as a firearm or a paintball marker, is able to fire or launch ammunition continuously as long as the ammunition is available. Ammunition, for example, can be bullet for hand guns. Also, ammunition can be paintball for a paintball guns. To enhance firing power, a type projectile propelling system employs a magazine which houses ammunition. A conventional magazine is a special container loaded with ammunition in such a way that, when the magazine is attached to a firearm, the ammunition in the magazine can be sequentially loaded and locked into a firing chamber by the loading mechanism of the firearm before ammunition can be launched.

For an automatic or semi-automatic firing apparatus, a projectile chamber is fired when a trigger is pulled. As soon as a projectile is fired, a retract mechanism of a firearm, for example, reloads the next projectile or bullet from the magazine for the subsequent firing. As the firing speed increases, more ammunition is needed to maintain the firing power. When ammunition in the magazine depletes, the projectile propelling system stops firing until the empty magazine is replaced with a fully loaded magazine.

To supply and provide sufficient amount of ammunition, users or operators usually carry multiple loaded magazines with a finite amount of ammunition such as bullets. When ammunition inside a magazine depletes, the user replaces the magazine by removing the empty magazine from the projectile propelling system such as a gun and reattaching a fully loaded magazine before a projectile can be fired. Projectile propelling is interrupted or halted during the process of replacing a magazine. To minimize firing interruption from magazine replacement, reducing the frequency of magazine replacement as well as minimum effort of magazine replacement can be essential.

A problem associated with a conventional ammunition magazine is that it holds a limited amount of ammunition or projectiles. Another drawback associated with a conventional ammunition magazine is that it carries one type of ammunition.

SUMMARY

Embodiments of the present invention disclose an ammunition magazine having two or more supply ports. The magazine includes a first ammunition supply port ("ASP"), a second ASP, a first ammunition compartment, and a second ammunition compartment. The first ASP, in one embodiment, is able to couple to a coupling surface of the magazine and provide ammunition to a gun when the first ASP is connected to an ammunition loading port ("ALP") of the gun. The second ASP is also coupled to the coupling surface of the magazine and provides ammunition to the gun when the second ASP is connected to the ALP of the gun. The first ammunition compartment occupies a first portion of ammunition capacity of the magazine and is able to arrange ammunition in a column formation. The second ammunition compartment occupies a second portion of ammunition capacity of the magazine and is able to arrange ammunition in a column formation. Each column of ammunition is supported by a follower which is coupled to a spring residing inside of a casing of the magazine.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
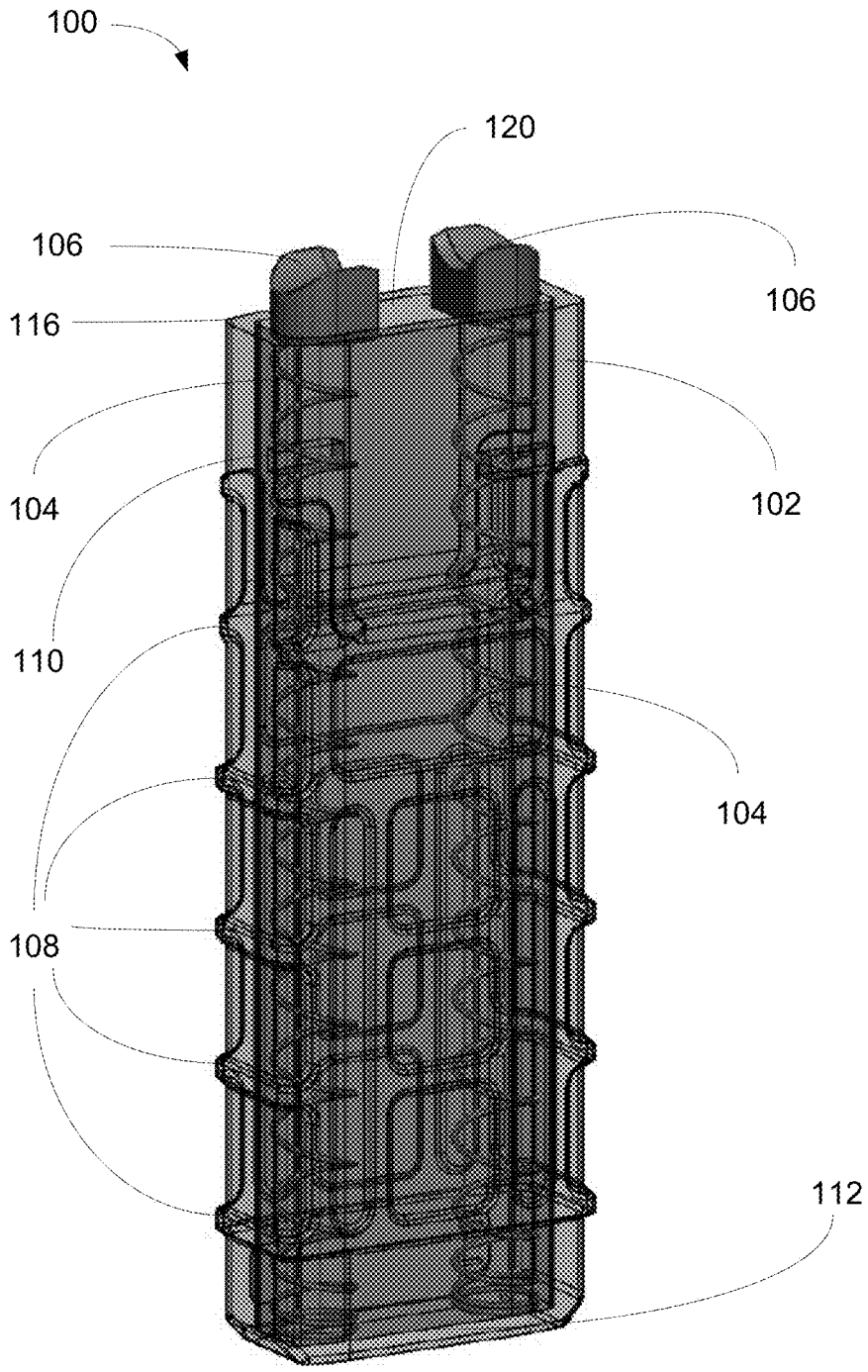
FIG. 1 is a diagram illustrating an exemplary ammunition magazine having two supply ports capable of carrying multiple ammunitions in column configuration in accordance with one embodiment of the present invention.

Exemplary embodiment(s) of the present invention is described herein in the context of a method, system and apparatus of providing ammunition to a projectile propelling system ("PPS") having two or more ammunition supply ports ("ASP").

Those of ordinary skills in the art will realize that the following detailed description of the exemplary embodiment (s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment (s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

An ammunition magazine includes two ammunition supply ports ("ASP"), a first ASP and a second ASP, and two ammunition compartments, a first ammunition compartment and a second ammunition compartment. The first ASP, in one embodiment, is able to couple to a coupling surface of the magazine and provide ammunition to a gun when the first ASP is connected to an ammunition loading port ("ALP") of the gun. The second ASP is also coupled to the coupling surface of the magazine and provides ammunition to the gun when the second ASP is connected to the ALP of the gun. The first ammunition compartment occupies the first portion of ammunition capacity of the magazine and is able to arrange ammunition in a column formation. The second ammunition compartment occupies the second portion of ammunition capacity of the magazine and is able to arrange ammunition in a column formation.

In an alternative embodiment, a magazine includes a casing, a spring, and a follower wherein the casing includes an open end, closed end, and wall linking the open end and the closed end. The open end is configured as a coupling surface to accept the first column of ammunition and the second column of ammunition. The first column of ammunition and the second column of ammunition are situated in a back-to-back inline configuration wherein each of the first and second columns couples to an ALP of PPS. The spring is connected to the inside surface of the closed end. The follower has the first surface configured to be in contact with the ammunition, and the second surface coupled to the second spring end. The PPSs are herein referred to as firearms, lethal weapon, non-lethal weapon, paintball markers, and/or tranquilizing guns.

FIG. 1 is a diagram 100 illustrating an exemplary ammunition magazine having two supply ports capable of carrying multiple ammunitions in column configuration in accordance with one embodiment of the present invention. The magazine 100 includes a casing 102 having an open end 120, a closed end 112 and walls linking the open end 120 and the close end 112. The open end 120 is configured to form a coupling surface 116 which connects or contacts to a receiving port of PPS, not shown in FIG. 1. In an alternative embodiment, the open end 120 is partially open or solid surface with two ASPs. It should be noted that the underlying concept of the exemplary embodiment(s) of the present invention would not change if one or more components (or units) were added to or removed from diagram 100.

The casing 102, in one embodiment, is configured to form two ammunition compartments wherein each compartment contains a spring 104 and a follower 106. The structural reinforcement features 108 may be manufactured on the walls to provide additional structural strength and/or support for the casing 102. The reinforcement features 108 also create additional surface textures for grasping and handling of the magazine 100. According to one embodiment, casing 102 can be made of metals, plastic, alloys, composite material, polymers, et cetera. Note that the magazine 102 can be either disposable or reusable.

A latch means 110 located on the walls of the casing is used to secure the magazine 100 with the PPS via a receiving port or ARP. When the magazine 100, for example, is inserted or clicked into a receiving port or ARP of PPS, a latching mechanism on the PPS engages, affix, or locks with the magazine 100 firmly with the PPS using the latch means 110. It should be noted that the location, shape, and size of the latch means 110 appeared on the magazine 100 should not be limited to those shown in FIG. 1. Note that any types of coupling mechanism that provides latching and releasing functions can be used to secure the magazine 100 to the PPS.

The spring 104 has two ends wherein one end of the spring 104 is attached to surface of the closed end 112 inside the casing 102 and the other end of the spring 104 is attached to a lower surface of the follower 106. The spring 104, which can be in any shapes or configurations, provides a function of elastic force capable of pushing an object in a predefined direction. For example, the spring 104 is a single-wired helix coil spring, and is made of metal, plastics, composite materials, polymers or the likes. As ammunition is loaded into the magazine, the spring 104 is compressed. The compression of spring 104 provides a necessary force to push the ammunition into a loading chamber when the ASP of the magazine 100 is coupled to an ALP of PPS. The length or size of the spring 104 is predetermined or configured such that it provides adequate pushing force to load a piece of ammunition into the loading chamber.

The follower 106 is configured to accept ammunition and to manage movements of ammunition in a column formation. The follower 106 has a top surface and a bottom surface wherein the bottom surface attaches to one end of the spring 104. Depending on the applications, configuration of the top surface of the follower 106 is shaped in such a way that it is able to seat or provide stable support to the ammunition in the magazine 101. Alternatively, design of the follower 106 conforms to loading mechanism of PPS whereby, during loading of the last piece of ammunition, the follower 106 does not interfere with loading and/or firing mechanism of the PPS. The follower 106, in one aspect, can be selectively changed based on the type of ammunition used. The followers 106 can be made with solid material, such as metal, plastic, composite materials, polymers, or the like.

Figure 2:
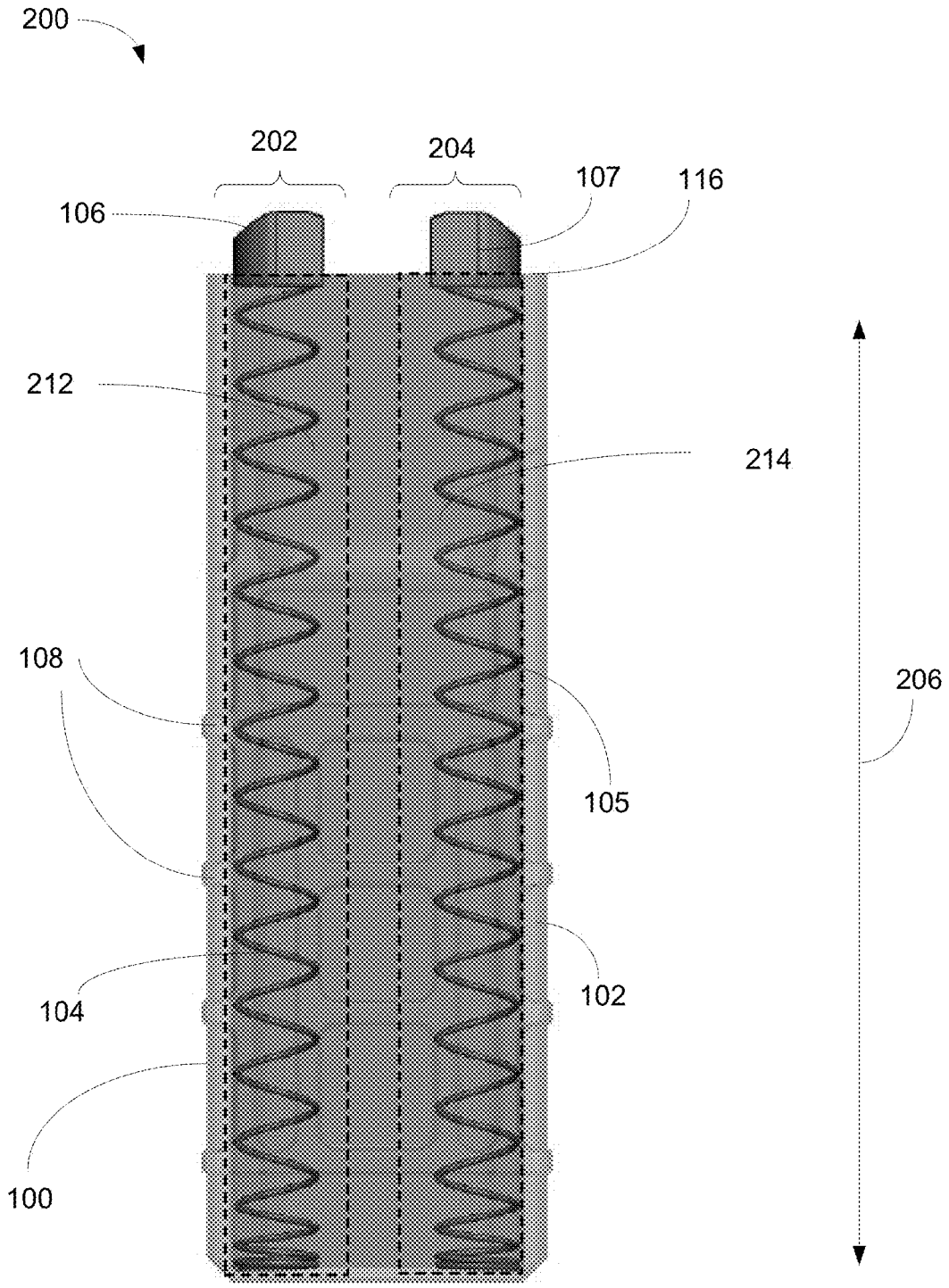
FIG. 2 is a diagram illustrating internal structure of the ammunition magazine in accordance with one embodiment of the present invention.

FIG. 2 is a diagram 200 illustrating internal structure of the ammunition magazine 100 in accordance with one embodiment of the present invention. The magazine 100 includes a casing 102, coupling surface 116, two springs 104-105, two followers 106-107, and two ammunition compartments 212-214, wherein the coupling surface 116 further includes two ammunition supply ports or ASPs 202-204. The magazine 100 may include additional components for storing the projectiles, but they are not necessary to understand the embodiments of the present invention.

The magazine 100, in one embodiment, stores ammunition or projectiles in the ammunition compartments 212-214 wherein the ammunition compartments 212-214 are configured in cylindrical column configuration. Two columns of ammunition compartments 212-214, for example, are organized side by side and parallel with each other inside of magazine 100. The follower 106 coupled with the spring 104, for example, can move freely within the channel of ammunition compartment 212. Similarly, the follower 107 coupled with the spring 105 can also move up-and-down freely in a direction indicated by numeral 206 within the channel of ammunition compartment 214. When ammunition or projectiles are loaded, columns of ammunition loaded inside the ammunition compartments 212-214, which is situated side by side and parallel with each other, are referred to as back-to-back inline configuration of ammunition. Each ammunition compartment occupies a portion of the total capacity of the magazine 100. In an alternative embodiment, the magazine 100 includes more than two (2) ammunition compartments for holding additional ammunition with additional ASPs.

The ASPs 202-204 situated on top portion of ammunition compartments 212-214 are configured to couple to the ALPs of PPS. The ASPs 202-204 are used for receiving ammunition as well as supplying ammunition. For example, to load ammunition or projectiles into the magazine 100, a piece of ammunition or projectile is loaded through ASP 202 by applying a downward force on the projectile to push the follower 106 into the ammunition compartment 212. By compressing the spring 104, subsequent ammunition or projectiles are loaded one piece at a time on top of a previously loaded projectile to form a column formation controlled and positioned by the follower 106 and the spring 104 in the ammunition compartment 212.

For instance, to charge or load ammunition compartment 204, ammunition is loaded from the ASP 204 by placing the first piece of ammunition on the follower 107. While pushing the follower 106 in a downward direction, the loading of ammunition compresses the spring 104 and stacks subsequent ammunitions on top of each other in a column configuration as the ammunition or projectiles are formed in a back-to-back inline configuration. Note that back-to-back refers that back ends of projectiles in the ammunition compartment 212 face the back ends of projectiles in the ammunition compartment 214 when projectiles has a front end and a back end.

Each of the ASPs 202 and 204 is configured to couple to an ALP of a firearm or a paintball marker. When the magazine 100 is securely affixed to a receiving port of a firearm, for example, the ASP 202 is coupled to the firearm's ALP while the ASP 204 is blocked from supplying any ammunition. Note that the ASPs 202-204 are independent from each other. As such, the ammunition carried by the ammunition compartments can be different types or shapes, and the ammunition can be dispensed separately.

An advantage of using the embodiments of the magazine is that the magazine can carry, for example, lethal and non-lethal ammunition, such as bullets and rubber bullets carried by the separate compartments.

Figure 3B:
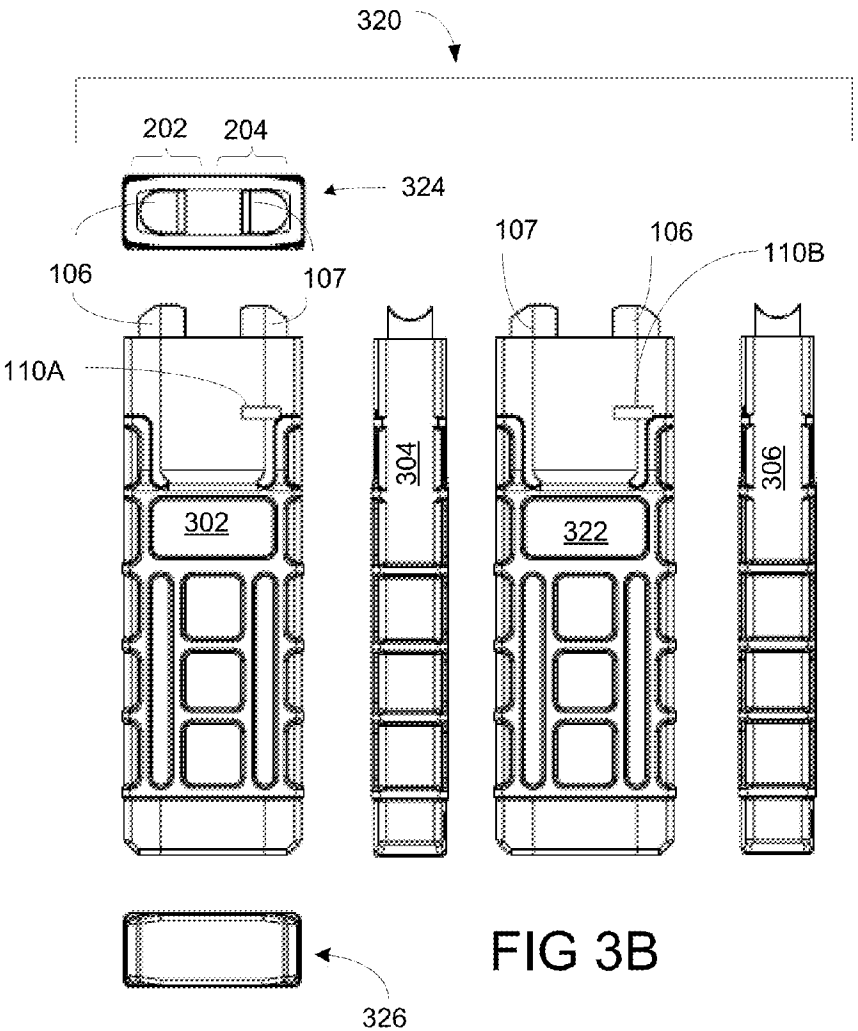
FIGS. 3A-B are three-dimensional ("3D") illustrations showing an appearance of an ammunition magazine having two ASPs in accordance with one embodiment of the invention showing the external appearance of the ammunition magazine in accordance with one embodiment of the present invention.
Figure 3A:
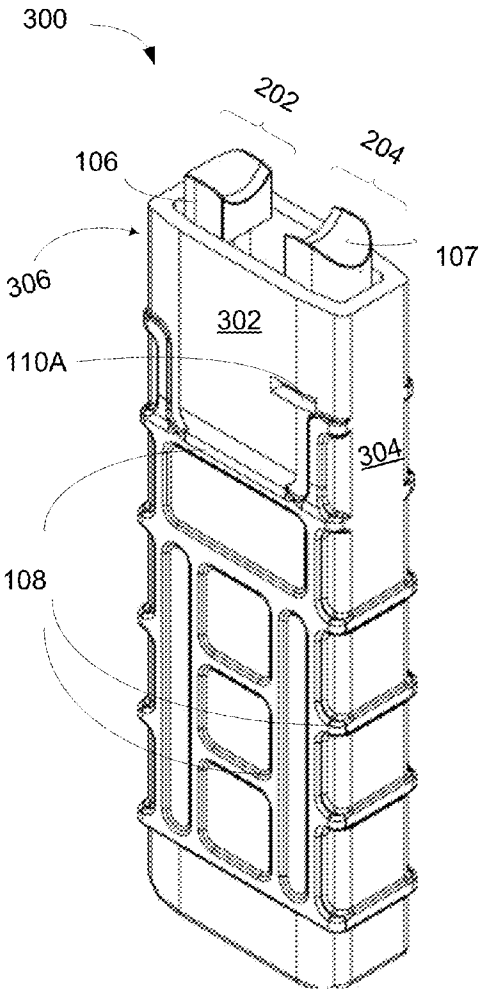

FIG. 3A is an exemplary a three-dimensional ("3D") illustration 300 showing an appearance of an ammunition magazine having two ASPs in accordance with one embodiment of the invention. The surface reinforcement features 108 present different formations and create a pattern having multiple partitions with raised ridges on the edge surfaces 304-306 of the casing. The raised ridges, for example, generate necessary friction to facilitate hand griping and handling. Two followers 106 and 107 are located inside of the respective ASPs 202-204, and are configured to receive ammunition. In one aspect, the latch mean 110A is indicated on the surface 302 of the magazine. It should be noted that the shape, type, location, and number of latch means 110A and 110B should not be limited to those being shown in the exemplary illustration.

FIG. 3B is a multiple-view graph 320 of diagram 300 in accordance with one embodiment of the present invention. The top-view graph 324 shows the two ASPs 202-204 and the followers 106 and 107 for accepting or handling two columns of ammunition. Bottom-view graph 326 shows the external bottom surface of the magazine casing. The left side of the magazine 302 includes a latch means 110A while right-side view of the magazine 322, which is the opposite to the left-side view 302, has a latch means 110B. The front side of the magazine 304 and the back side of the magazine 306 form a casing. Depending on the orientation of the magazine being plugged into the PPS, the front side and back side of magazine can change.

Latch means 110A and 110B determine the orientation of how the magazine is attached to a PPS wherein the orientation of the magazine determines which column of ammunition of ammunition compartment is being used. For example, when the magazine is inserted into a firearm's magazine receiving port with the latch means 110A engaged, the ASP 202 is coupled to the ALP of PPS, and the column of ammunition controlled by the follower 106 is aligned with a loading chamber of the PPS. When the magazine is inserted into the PPS with latch means 110B engaged, the ASP 204 is coupled to the ALP of PPS and the column of ammunition carried by the follower 107 is aligned with the loading chamber.

Figures 4A, 4B, 4C:
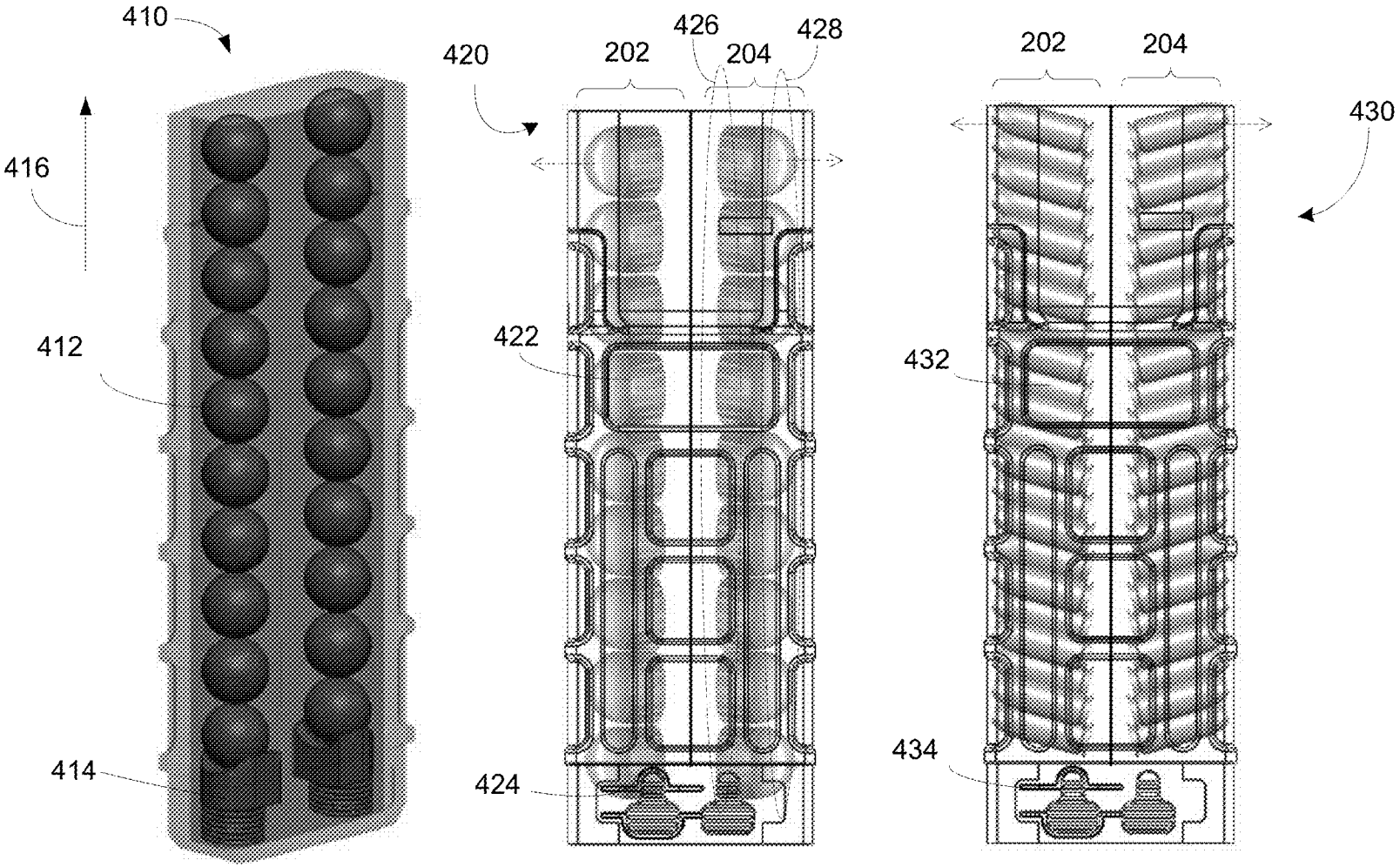
FIG. 4 A-D are diagrams showing the ammunition magazine loaded with different types of ammunitions in accordance with embodiments of the present invention.

FIGS. 4A-C are exemplary diagrams showing ammunition magazine having two ASPs loaded with ammunition organized in a back-to-back inline configuration in accordance with embodiments of the present invention. FIG. 4A is a diagram 410 showing the ammunition magazine carrying two columns of round-shaped ammunition 412. Followers 414 configured to hold round-shaped or spherical ammunition are used to push the ammunition upward as indicated by numeral 416. In one aspect, ammunition 412 is paintballs. Note that paintball or paint projectile leaves a colored marker upon an impact of a paintball. Ammunition 412, which can be shaped as a dart shape, is non-lethal tranquilizer that can be used to control human or animals.

FIG. 4B is a diagram 420 showing the ammunition magazine charged with two columns of fin-based ammunition 422. Followers 424 are configured to seat fin-based ammunition to push the fin-based ammunition in a direction indicated by numeral 416. Each of the ASPs 202-204 is configured to couple to an ALS of PPS such as a loading port of a paintball marker. Note that each ammunition or projectile such as projectile 422 has a front end 428 and a back end 426. A back-to-back inline ammunition configuration is formed when two back ends of ammunition are aligned in column formation. In one aspect, projectiles 422 are paintballs.

FIG. 4C is a diagram 430 showing the ammunition magazine loaded with two columns of bullet-shaped ammunition 432. The followers 434 is designed to hold or seat the projectile or ammunition 432 to push the projectile 432 in a direction indicated by numeral 416. Each of the ASPs 202-204 is configured to couple to an ALP of PPS capable of firing ammunition 432. The ammunition 432, in one embodiment, is lethal ammunition such as bullets. Alternatively, the ammunition 432 can be non-lethal ammunition such as rubber bullets. In yet another embodiment, ammunition 432 can be a combination of bullets and rubber bullets separated by columns. Referring back to FIGS. 4B-C, two columns of ammunition are arranged in a back-to-back inline configuration in which ammunition launching direction is appointed away from the center of the magazine as shown by dash-line arrows.

Figure 4D:
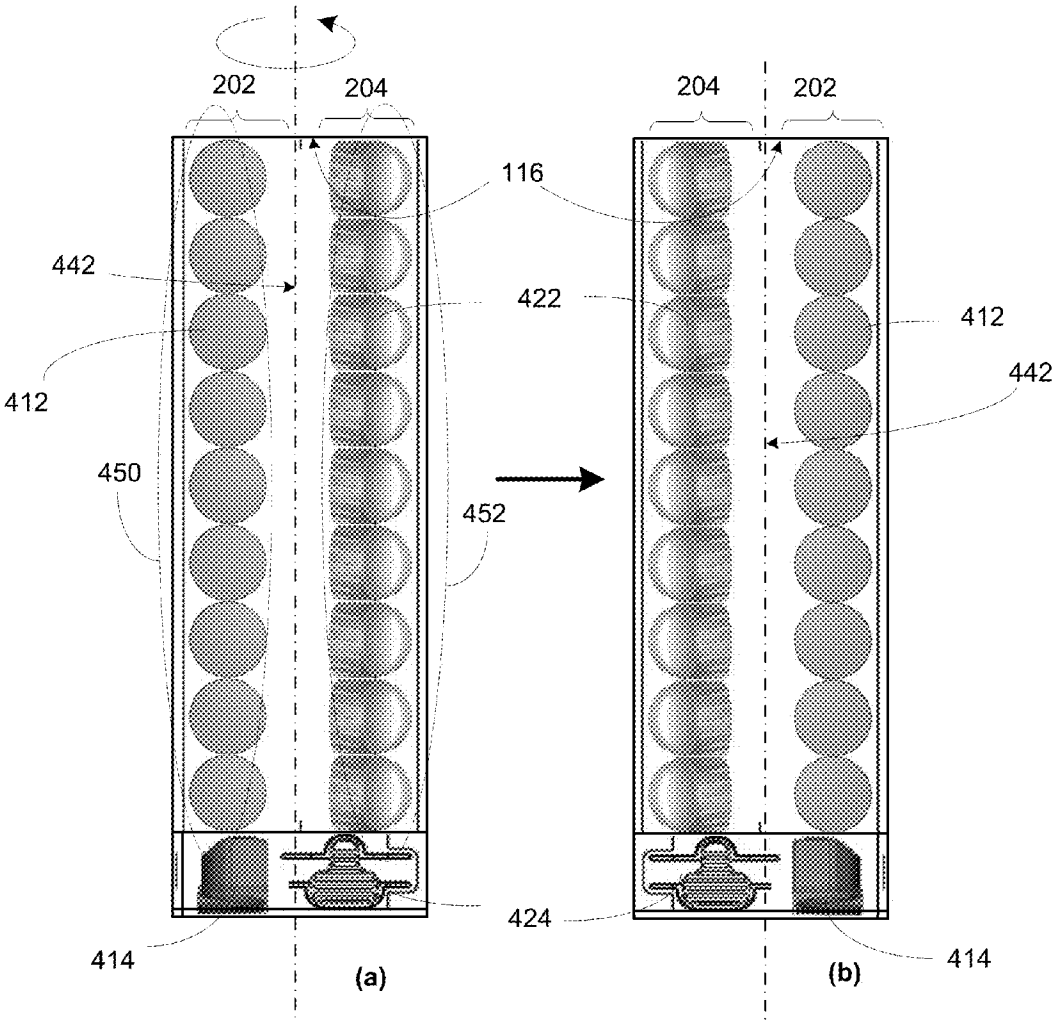

FIG. 4D is an exemplary diagram illustrating an ammunition magazine with two supply ports carrying two different types of ammunitions in accordance with one embodiment of present invention. Referring to FIG. 4D(a), the magazine having two ASPs 202-204 contains two columns 450-452 of ammunition organized in a back-to-back inline configuration. The column 450, in one embodiment, includes a column of multiple round-shaped projectiles 412 and the column 452 includes a column of fin-based projectiles 422 coupled to ASPs 202-204, respectively. The follower 414 is configured to seat with the round-shaped projectiles 412 while the follower 424 is configured to seat with the fin-based projectiles 422 wherein the followers 414 and 424 are configured to push the projectiles in a direction moving from the bottom of the casing to the top of the casing toward ASPs 202-204.

When the magazine, as illustrated in FIG. 4D(a), is inserted into the body of PPS, the ASP 202 is coupled to the ALP of PPS for passing projections from ASP 202 to PPS while the ASP 204 is blocked from supplying any ammunition. Once the ASP 202 and the ALP of PPS are connected, the projectile 412 in the ammunition column 450 which corresponds with ASP 202 is used to supply ammunition to the PPS. To access ammunition or projectiles 422 in column 452, the magazine is detached from the receiving port or ALP of PPS, and then is rotated along a longitudinal axis 442 for a half rotation or 180 degrees. After the rotation, the magazine is re-inserted or plugged into the receiving port or ALP of PPS. Once the magazine is inserted into the PPS, the ASP 202 is blocked and ASP 204 is engaged with ALP of the PPS for supplying projectiles to the PPS. The column 452 containing ammunition 422 is now responsible to supply the ammunition.

It should be noted that the longitudinal axis of the magazine is an axis perpendicular to the coupling surface 116. FIG. 4D(b) shows a configuration of the magazine after the 180-degree rotation from the magazine shown in FIG. 4D(a). The half rotation of the magazine, in one embodiment, switches the position of supply ports or ASPs 202-204 relative to the ALP of PPS. In one embodiment, the PPS is a paintball marker.

In one embodiment, the columns 450-452 of the ammunition in the magazine have different types of ammunition. For example, the column 450 carries round-shaped projectiles and the column 452 carries fin-based projectiles wherein both columns 450-452 are located in the same magazine. With an ammunition magazine containing different ammunitions in the columns or ammunition compartments, an operator of PPS can select his or her ammunition by simply detaching the magazine and reattaching the magazine to the PPS after rotating the magazine around its longitudinal axis for a half rotation.

An advantage of employing a magazine having multiple supplying ports is allowing a single magazine to carry multiple types of ammunition.

For example, in dealing with animal controls, a firearm user may need to switch from tranquillizers to live ammunition depending on the situations. For another example, riot policemen may be required to carry non-lethal ammunition, e.g. rubber bullets, and lethal ammunition wherein the non-lethal ammunition may be used to deter and/or contain a crowd while the lethal ammunition such as bullets may be needed if the situation requires. Accordingly, a prompt switch between tranquillizers and live ammunition, or between non-lethal ammunition and lethal ammunition, can be important.

Figure 5:
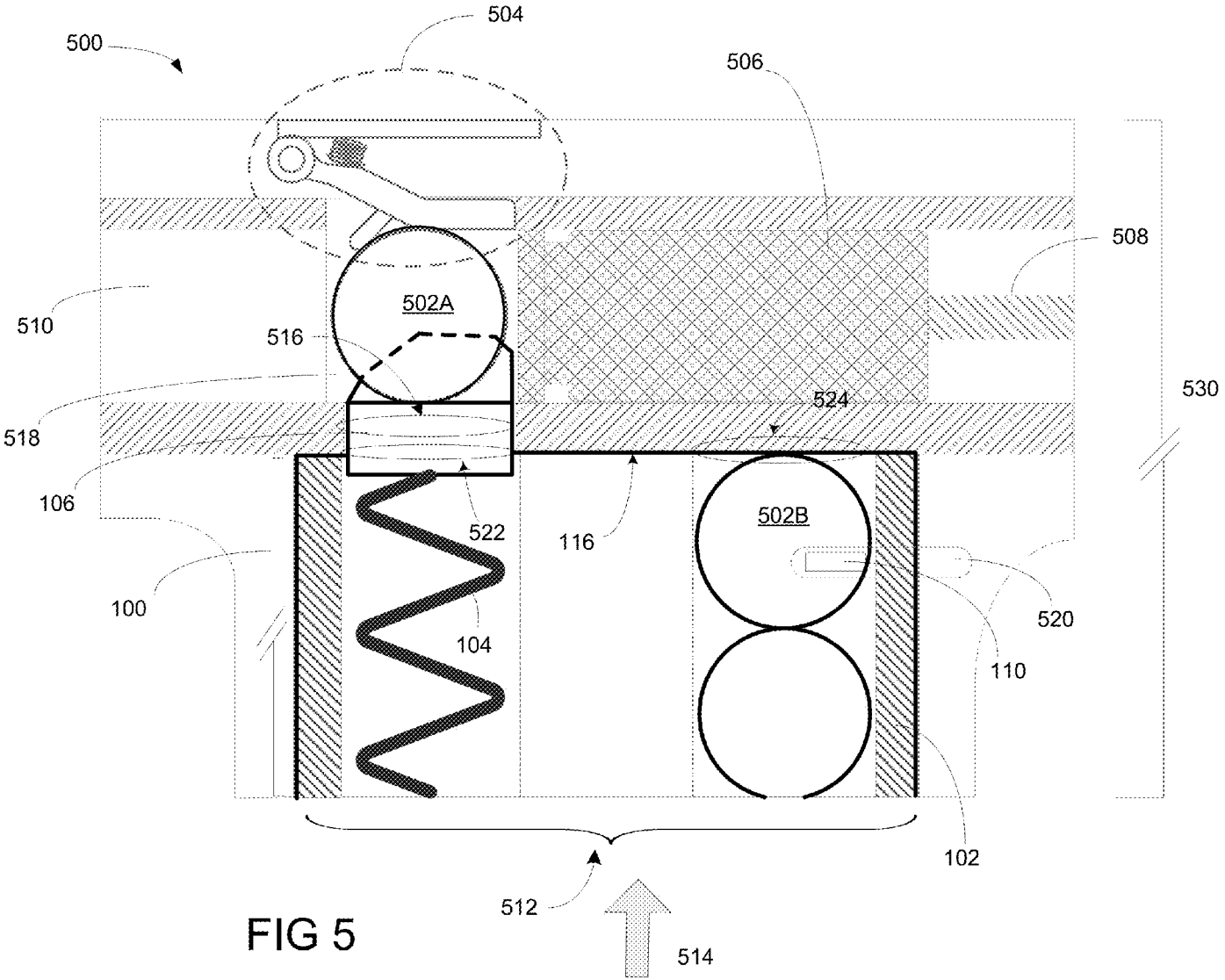
FIG. 5 is an exemplary illustration showing a cross-section view of the ammunition magazine coupled to a paintball marker with one of the ammunition supply port coupled to a ammunition loading port in accordance with one embodiment of the present invention.

FIG. 5 is an exemplary illustration 500 showing a cross-section view of a dual-supply port ammunition magazine 100 coupled to a paintball marker 530 in accordance with one embodiment of the present invention. The paintball marker 530 includes a main valve 508, a bolt 506, a paintball catcher assembly 504, a loading chamber 518, a firing chamber/barrel 510, an ammunition loading port or ALP 516 and a magazine receiving port 512. The ammunition magazine 100 includes a casing 102 having a coupling surface 116 with two ammunition supply ports or ASPs 522 and 524. Coupling to the ASPs 522 and 524 are two columns of ammunitions containing ammunition 502A and 502B respectively. Each column of ammunition is supported by a follower 106 and a spring 104. The magazine 100 is attached to the paintball marker through the engagement of a pair of latch couplings 110 and 520, wherein the latch coupling 110 is located on the magazine 100 and the latch coupling 520 is located on the paintball marker 530. It should be noted that the underlying concept of the exemplary embodiment(s) of the present invention would not change if one or more components (or units) were added to or removed from diagram 500.

In operation, the magazine 100 is inserted into the receiving port 512 from a direction indicated by arrow 514 until the latching coupling pair 110 and 520 that are securely engaged. When the magazine is attached to the paintball marker 530, the ASP 522 and ALP 516 are connected while the ASP 524 is blocked from supplying ammunition. When a projectile moves from the ammunition column to the ASP 522, the projectile is loaded to the loading chamber 518 for firing or launching. When a trigger is pulled, a pressurized gas is introduced through the main valve 508, which controls and regulates pressurized gas to move the bolt 506. While bolt 506 moves forward, the paintball catcher assembly 504 releases the projectile or paintball 502A. The projectile or paintball 502A is fired via the barrel 510. After the paintball is launched, a retract mechanism, not shown in FIG. 5, retracts the bolt 506 to its prior-launching position and ready for the next firing. The next projectile or paintball is subsequently loaded via ASP 522 wherein the paintball or projectile is managed or controlled by follower 516 and spring 104.

After the last piece of ammunition 502A is launched, the ammunition column under supply port 522 is empty. To reload, a user can switch from an empty column to the full column by detaching the magazine and reattaching the magazine after a half rotation. The paintball marker is now armed and ready for firing. According to one embodiment, the half rotation of the magazine about its longitudinal axis also brings into position the other piece of latch means 110, which is configured for latching the magazine in the orientation to couple the ASP 524 to the ALP 516.

Figure 6A:
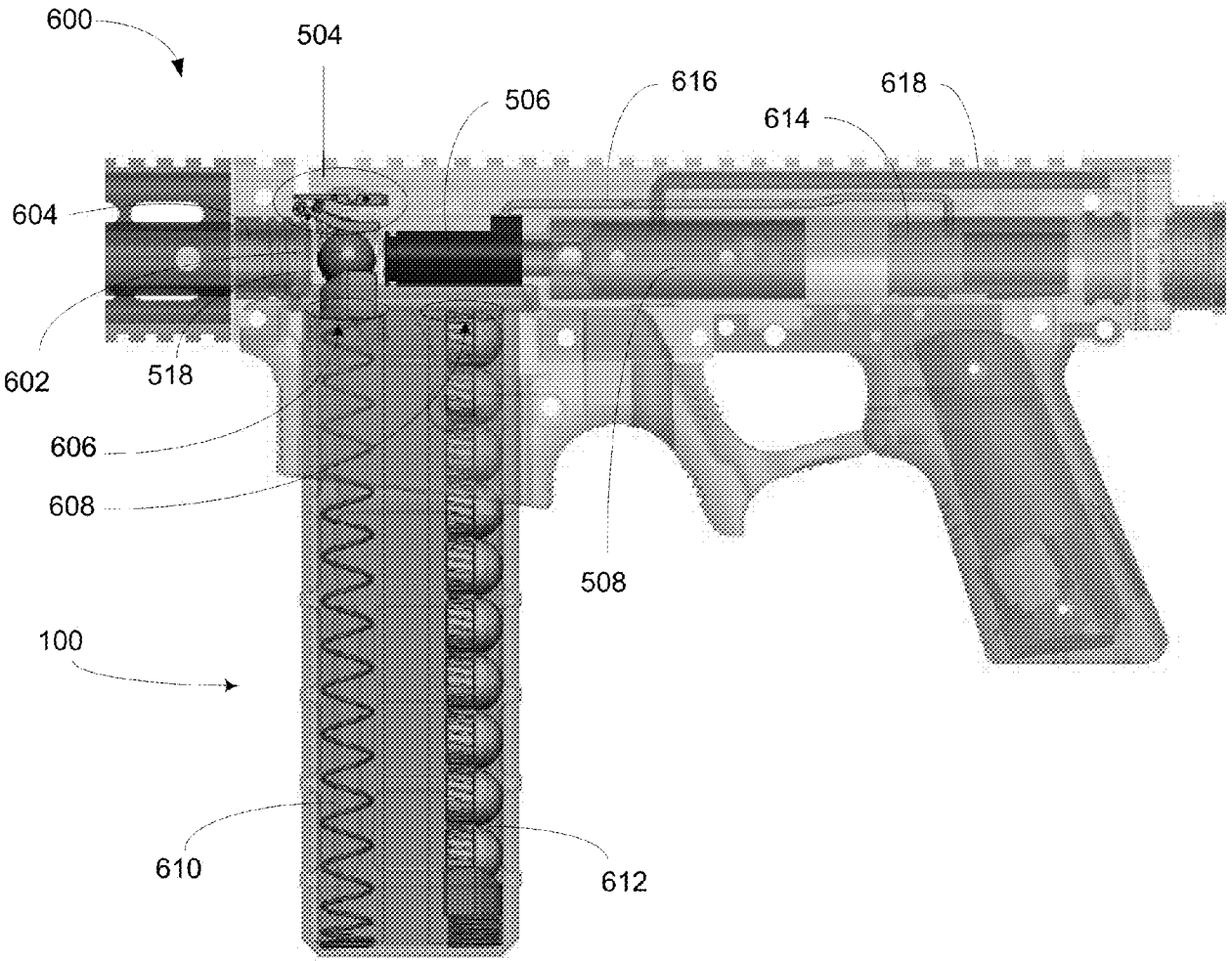
FIG. 6A is a diagram illustrating a paintball marker or gun coupled to an ammunition magazine having two ASPs in accordance with one embodiment of the invention.

FIG. 6A is a diagram 600 illustrating a paintball marker or gun coupled to an ammunition magazine having two ASPs in accordance with one embodiment of the invention. The diagram 600 includes a paintball marker and a magazine 100, wherein the magazine 100 has two ASPs 606 and 608. The ASP 606 of the magazine 100 is coupled to the ALP of the paintball marker. It should be noted that the underlying concept of the exemplary embodiment(s) of the present invention would not change if one or more components (or elements) were added to or removed from diagram 600.

The magazine 100 includes a first ammunition compartment 610 and a second ammunition compartment 612 wherein the first ammunition compartment 610 carries spherical paintballs as ammunition. is coupled to supply port 606. The second ammunition compartment 612 carries fin-based paintballs. The first ammunition compartment 610 supplies paintballs to the ASP 606 and the second ammunition compartment 612 capable of supplying fin-based paintballs. The ASP 606 is coupled to a loading port 518 of the paintball marker and the ASP 608 is blocked.

During an operation, a paintball 602 in the first compartment 610 is loaded to the loading chamber 518 and is positioned at an optimal location by a paintball catch assembly 504. A bolt 506 is used to push and launch paintball 602. To launch the paintball 602 situated in the loading chamber 518, a pressurized gas is channeled via a pressure line 618 to a main valve 508, which regulates and releases pressure to the bolt 506 to push the paintball into a firing chamber 604. At this instance, a hammer 614 connected to the bolt 506 by connecting rod 616 contacts the main control valve 508 to trigger a release of pressurized gas from pressure gas line 618 to propel the paintball.

Figure 6B:
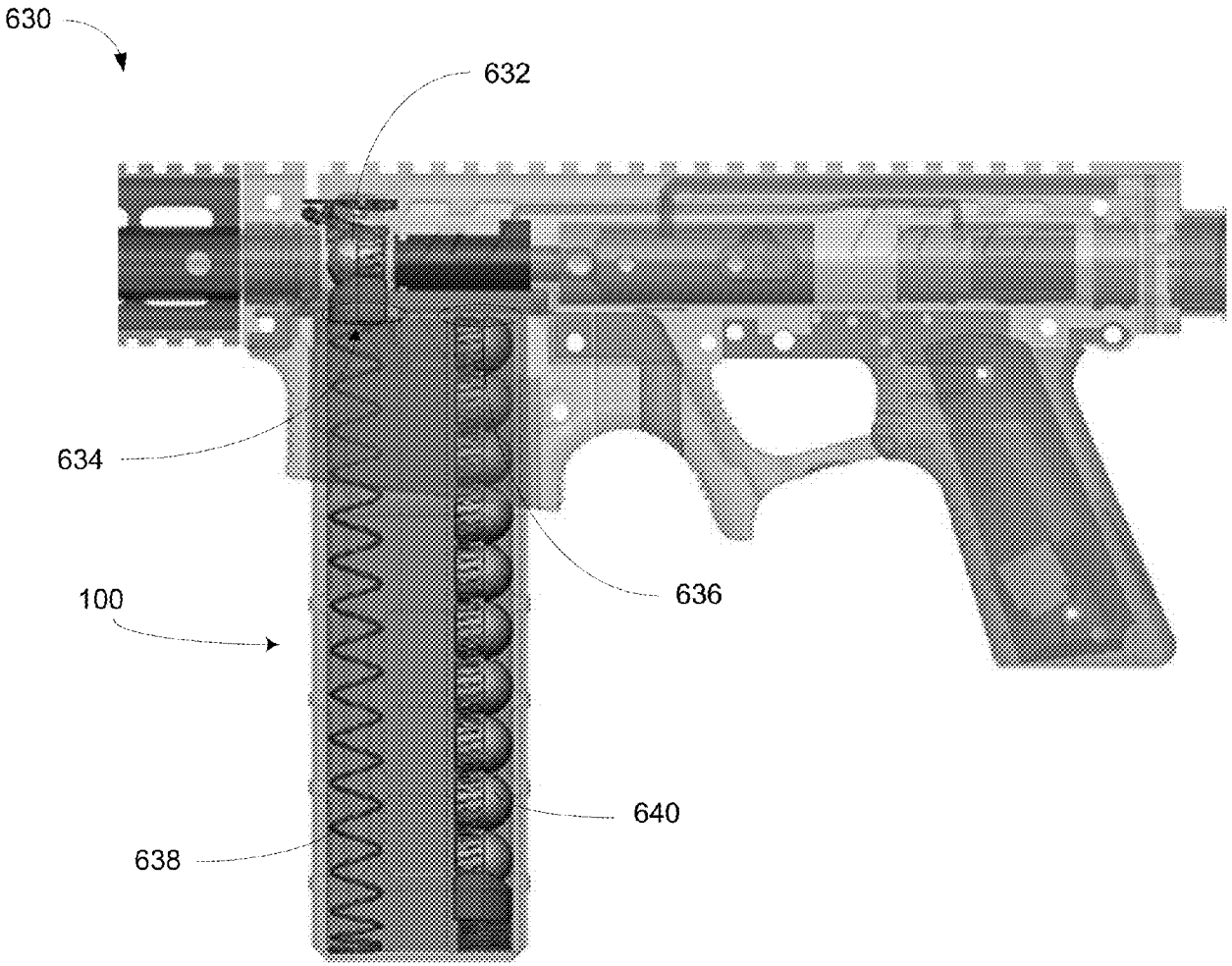
FIG. 6B is an exemplary illustration showing the ammunition magazine carrying two columns of fin-attached spherical paintballs and coupled to a paintball marker in accordance with one embodiment of the present invention.
Figure 6C:
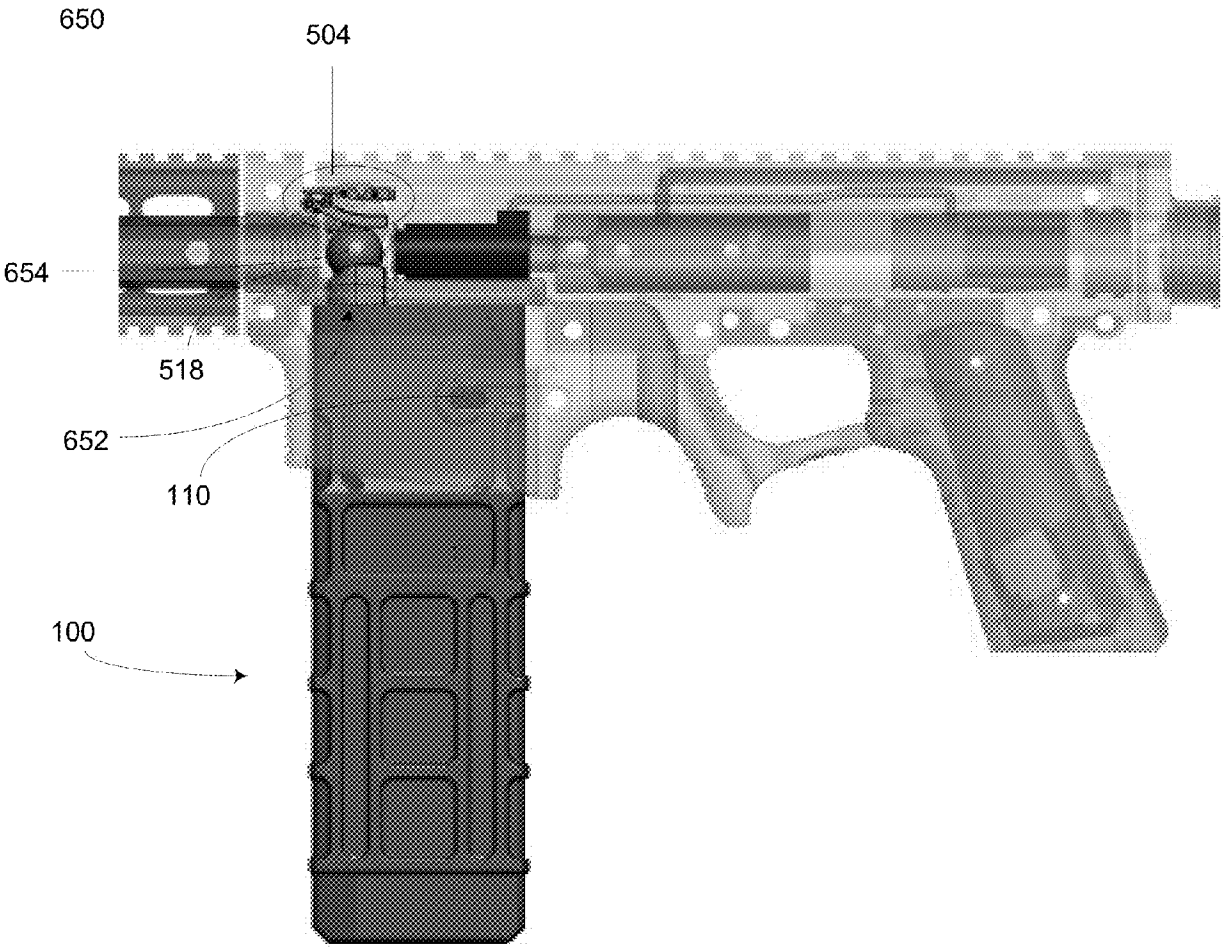
FIG. 6C is an exemplary illustration showing the ammunition magazine carrying spherical paintballs and coupled to a paintball marker in accordance with one embodiment of the present invention.

FIG. 6B is an exemplary illustration 630 showing an ammunition magazine 100 having two supply ports and attached to a paintball marker in accordance with one embodiment of present invention. Ammunition compartments 638 and 640 are coupled to supply ports 634 and 636 respectively. Both ammunition compartments are loaded with fin-based paintballs 632. FIG. 6C is an exemplary illustration 650 showing an ammunition magazine 100 having two supply ports and attached to a paintball marker. Spherical paintballs are carried by magazine 100. Supply port 652 is coupled to a loading chamber of the paintball marker. A piece of spherical ammunition 654 in a first compartment is loaded through supply port 652 and is secured in an optimal location by a paintball catcher assembly 504. By loading the same type of ammunition in multiple ammunition compartments, the magazine with two or more supply ports according to the present invention increases the carrying capacity.

Figure 7:
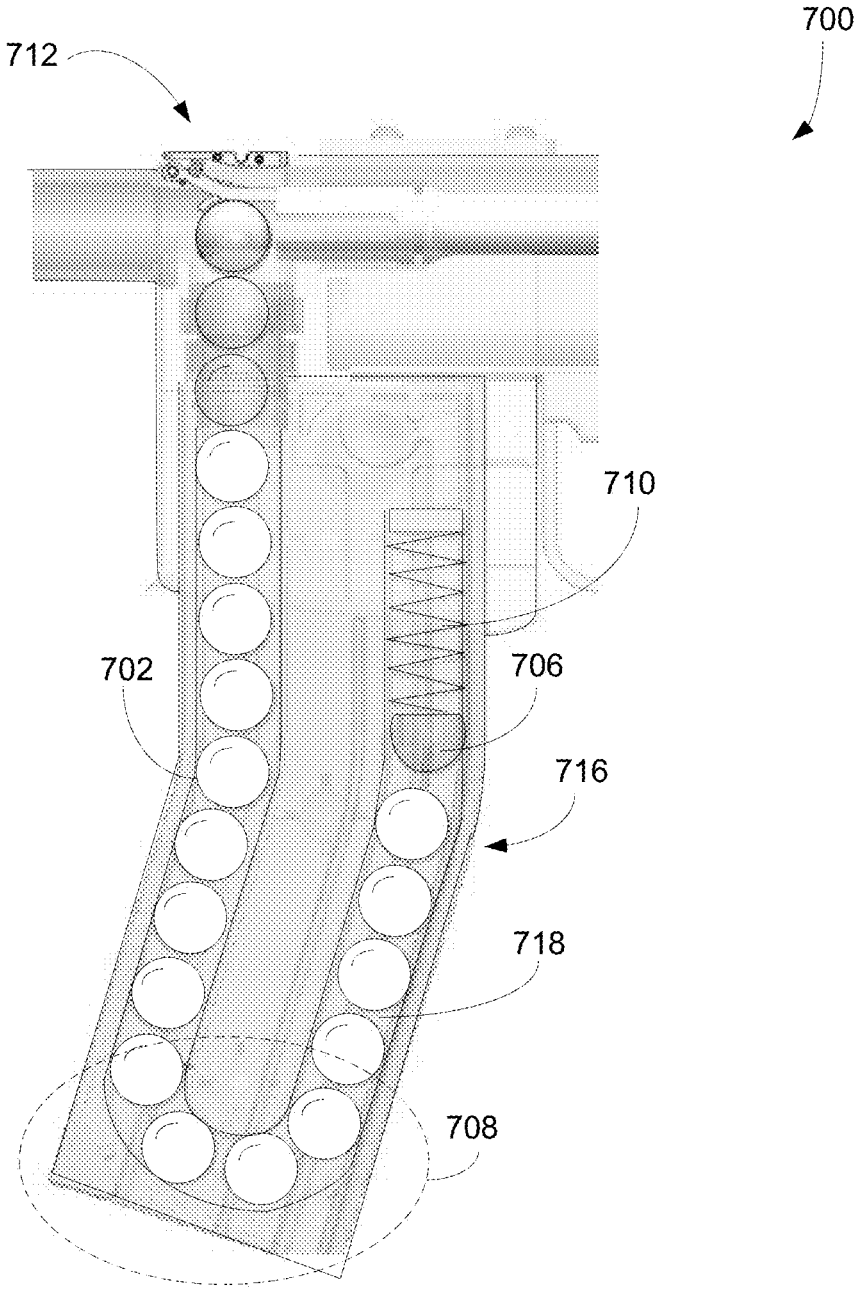
FIG. 7 is a diagram illustrating an alternative configuration of a magazine capable of supplying ammunition in accordance with one embodiment of the present invention.

FIG. 7 is a diagram 700 illustrating an alternative configuration of a magazine capable of supplying ammunition in accordance with one embodiment of the present invention. Diagram 700 includes a PPS 712 and a magazine 716, wherein the magazine 716 further includes a U-shaped storage channel 718, a follower 706, and a spring 710. The U-shaped storage channel 718 is able to house multiple projectiles 702 wherein the projectiles 702 are pushed or managed by the spring 710 having the follower 706. When the magazine 716 is loaded with projectiles 702, all of projectiles or paintballs 702 travel through the U-shaped storage channel 718 before they are being launched. It should be noted that the dimension 708 of the U-shaped storage channel 718 can and should change according to the ammunition used. An advantage of using the magazine illustrated in diagram 700 is to maximize the usage of available space in the magazine.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A projectile propelling system, comprising:

a paintball marker containing a main valve, a bolt, and a gas pressurized propelling mechanism;

a casing coupled to the paintball marker, and having an open end, a closed end, and a wall, wherein the open end is situated opposite to the closed end, and the wall links the open end and the closed end, wherein the open end is configured to accept a first column of ammunition and a second column of ammunition, wherein the first column of ammunition and the second column of ammunition are situated in a back-to-back inline configuration, wherein each column of ammunition is configured to couple to an ammunition loading port of the paintball marker, wherein the first column of ammunition and the second column of ammunition include a plurality of paintballs;

a spring, coupled to the casing, having a first spring end and a second spring end, wherein the first end of the spring is connected to a surface of the closed end; and a follower having a first surface and a second surface, wherein the first surface is in contact with ammunition and the second surface is coupled to the second spring end.

2. The system of claim 1, wherein the first column of ammunition includes a plurality of fin-based paintballs arranged in a column formation, wherein each paintball leaves a colored marker upon an impact.

3. The system of claim 2, wherein the plurality of fin-based paintballs with a predefined orientation is stacked on top of each other in a vertical configuration.

4. The system of claim 3, wherein the first column of ammunition contains a plurality of first type of paintballs and the second column of ammunition contains a plurality of second type of paintballs.

5. The system of claim 1, wherein the first column of ammunition includes a plurality of tranquillizers arranged in a column formation, wherein each tranquillizer is being propelled by a paintball marker.

6. The system of claim 1, wherein the first column of ammunition includes a plurality of ball-shaped paintballs arranged in a column formation.

7. The system of claim 1, wherein the casing further includes a latch configured to secure the magazine with the paintball marker.

8. The system of claim 1, wherein the first column of ammunition includes a plurality of paintballs arranged in a column formation, wherein each of the plurality of paintballs is a capsule containing coloring material capable of being propelled by the paintball marker.

9. The system of claim 8, wherein the plurality of paintballs is stacked one on top of another in a vertical column configuration.

10. The system of claim 9, wherein the first column of ammunition contains a plurality of round-shaped paintballs and the second column of ammunition contains a plurality of fin-based paintballs.

11. The system of claim 9, wherein the first column of ammunition includes a mixed type of paintballs including round-shaped and fin-based paintballs.

12. The system of claim 1, wherein the open end includes a first ammunition supply port and a second ammunition supply port, wherein the first ammunition supply port provides ammunition to the paintball marker when the first ammunition supply port is connected to an ammunition receiving port of the paintball marker and wherein the second ammunition supply port provides ammunition to the paintball marker when the second ammunition supply port is connected to an ammunition receiving port of the paintball marker.

* * * * *